US009097264B1

(12) United States Patent
Kennedy

(10) Patent No.: US 9,097,264 B1
(45) Date of Patent: Aug. 4, 2015

(54) TURBINE END HEATSINK

(71) Applicant: BorgWarner Inc., Auburn Hills, MI (US)

(72) Inventor: Donald Michael Kennedy, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 14/573,586

(22) Filed: Dec. 17, 2014

(51) Int. Cl.

| | |
|---|---|
| ***F01D 25/08*** | (2006.01) |
| ***F04D 29/58*** | (2006.01) |
| ***F04D 29/056*** | (2006.01) |
| ***F04D 17/10*** | (2006.01) |

(52) U.S. Cl.
CPC ..... *F04D 29/582* (2013.01); *F04D 17/10* (2013.01); *F04D 29/0563* (2013.01)

(58) Field of Classification Search
CPC ... F04D 29/582; F04D 29/0563; F04D 17/10; F01D 5/08; F01D 25/125; F01D 25/243; F05D 2260/22141
USPC ..... 415/177, 180
See application file for complete search history.

(56) References Cited

U.S. PATENT DOCUMENTS

| | | | | |
|---|---|---|---|---|
| 3,645,593 | A * | 2/1972 | Irwin | 384/476 |
| 4,786,238 | A * | 11/1988 | Glaser et al. | 417/53 |
| 5,087,082 | A * | 2/1992 | Anthonsen | 285/94 |
| 2007/0036664 | A1 * | 2/2007 | Shibui et al. | 417/407 |

* cited by examiner

*Primary Examiner* — Dwayne J White
*Assistant Examiner* — Jason Fountain
(74) *Attorney, Agent, or Firm* — BrooksGroup

(57) ABSTRACT

A product is disclosed for use with a turbocharging system. The product may include a bearing housing configured to house a bearing and having a flange. A shaft may extend through the bearing and a turbine wheel may be connected to one end of the shaft. A turbine housing may be disposed around the turbine wheel and may include an annular wall adapted to mate with the flange of the bearing housing. A cooling plate may comprise a washer shaped body and may be disposed around, and spaced apart from, the bearing housing. The cooling plate may be connected to the turbine housing to transfer heat from the turbine housing and away from the bearing housing.

20 Claims, 2 Drawing Sheets

TURBINE END HEATSINK

TECHNICAL FIELD

The field to which the disclosure generally relates may include turbocharging systems for internal combustion engines and in particular, may include turbocharging systems with a bearing housing positioned between a turbine and a compressor.

BACKGROUND

A turbocharging system may include a compressor driven by a turbine. The turbine may be connected to the compressor by a common shaft that is supported for rotation by bearings. The segment of the shaft that is supported by the bearings may extend through a bearing housing mounted between the turbine and the compressor. Rotation of the turbine drives the compressor through the common shaft to charge the combustion air intake system of an internal combustion engine. The turbine's wheel and the connected shaft may rotate at speeds that approach hundreds of thousands of revolutions per minute. In addition, the turbine wheel operates in a high temperature exhaust gas environment, wherein heat may be transferred to the other turbocharging system components. Under these harsh, and increasingly demanding operating conditions, the turbocharging system components are expected to operate for a lifespan of many years and continue to perform with the engine to which the system is applied. To perform as expected, the design of the turbocharging system components must be robust to survive as expected, while still being cost effective.

SUMMARY OF ILLUSTRATIVE VARIATIONS

According to a number of variations, a product may be provided for use with a turbocharging system. The product may include a bearing housing configured to house a bearing and having a flange. A shaft may extend through the bearing and a turbine wheel may be connected to one end of the shaft. A turbine housing may be disposed around the turbine wheel and may include an annular wall adapted to mate with the flange of the bearing housing. A cooling plate may comprise a body shaped to be disposed around, and spaced apart from, the bearing housing. The cooling plate may be connected to the turbine housing to transfer heat from the turbine housing and away from the bearing housing.

Other illustrative variations within the scope of the invention will become apparent from the detailed description provided herein. It should be understood that the detailed description and specific examples, while disclosing variations of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 1:
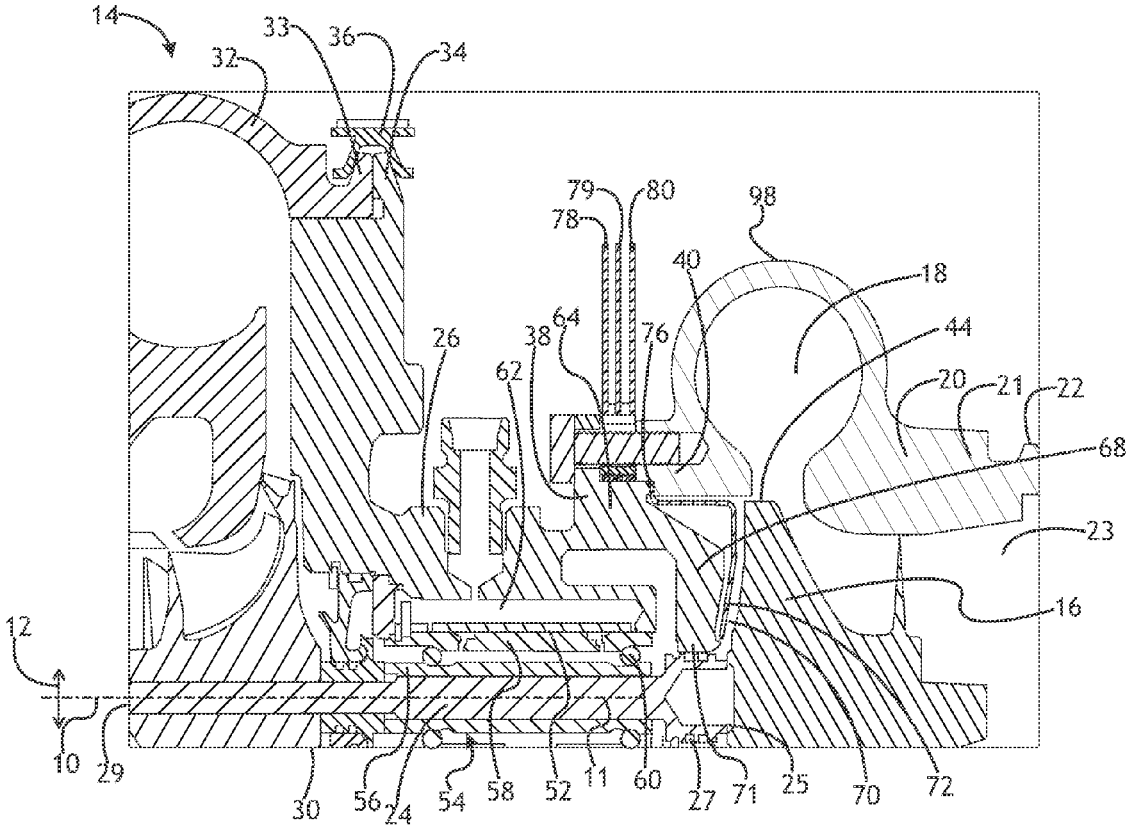
FIG. 1 is a fragmentary cross section illustration of a product for use with a turbocharging system according to a number of variations.

With reference to FIG. 1, a number of elements may be described in relation to an axial direction and a radial direction. In this regard, reference number 10 indicates a line that extends in the axial direction, which coincides with left and right in the view of FIG. 1. The line indicating the axial direction 10 is shown coinciding with a central axis 11 of the product 14 along the centerline of a shaft 24. An axial extending part will extend on a line parallel to, or on, the central axis 11. Reference numeral 12 indicates a line that extends in the radial direction, which means toward or away from the central axis 11, which is generally vertical as viewed in FIG. 1.

The product 14, may be used with a turbocharging system for an internal combustion engine and may provide a mechanism for dissipating heat. A turbine wheel 16 as shown in FIG. 1 may exist in a continuous high velocity jet of exhaust gases entering through the volute 18 when the engine is running. The volute 18 may be defined as a channel by a turbine housing 20, which may include an axially extending flange 21. The flange 21 may terminate at a radially outward extending flange 22, adapted for connection to an exhaust system. Exhaust from an associated engine may be channeled through the volute 18 and around the turbine wheel 16 to spin the turbine wheel 16, and may then be exhausted through a port 23.

The turbine wheel 16 may be connected to the shaft 24 at its end 25. The shaft 24 may include an enlarged segment at or near the end 25, which may have a number of annular grooves holding seal rings 27. The shaft 24 may extend in the axial direction 10 along the central axis 11, and through a cartridge assembly which may be referred to as a bearing housing 26.

The shaft 24 may include a reduced segment at or near an end 29 and may be connected to a compressor wheel 30. The compressor wheel 30 may rotate with the shaft 24 and turbine wheel 16. The compressor wheel 30 may be disposed to rotate in a compressor housing 32 to compress intake air for an associated engine. The bearing housing 26 may include a flange 34 on the compressor side, which may extend outwardly in the radial direction 11 and may be configured for connection to the compressor housing 32 at a flange 33 thereof. A band clamp 36 may be used to secure the bearing housing 26 to the compressor housing 32.

Figure 2:
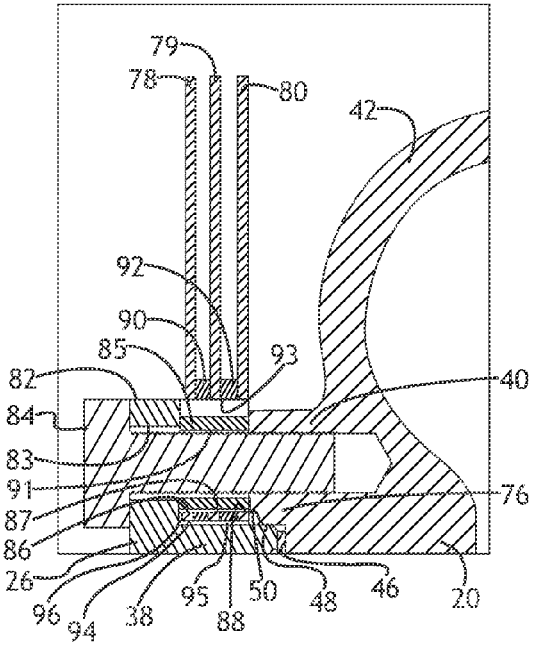
FIG. 2 is a detail fragmentary cross section illustration of the cooling plate area of the product shown in FIG. 1.

The bearing housing 26 may also have a flange 38 on the turbine side, which may be configured to mate with an annular axially extending wall 40 of the turbine housing 20. Referring additionally to FIG. 2, the wall 40 may extend from a housing section 42 that forms the volute 18, near the tip 44 of turbine wheel 16. At this location, the area of the turbine housing 20 may be exposed to the elevated temperatures associated with exhaust gases leaving the associated engine and as such, the wall 40 may readily absorb heat. An annular step 46 may be formed at an inside edge of the wall 40 and may present a radially inward facing circumferential surface 48 that extends around the central axis 11. The flange 38 of the bearing housing 26 may include a radially outward facing circumferential surface 50 that mates with the circumferential surface 48 to position the turbine housing 20 with the bearing housing 26. The mating circumferential surfaces 48, 50 may be the only direct contact between the turbine housing 20 and the bearing housing 26, and the width of the surfaces in the axial direction may be minimized to reduce the contact area for heat transfer. The width may be limited to that which is required to position the turbine housing 20 and bearing housing 26 together.

As shown in FIG. 1, an opening may be provided in the bearing housing 26 about the central axis 11 forming a bearing cavity 52. The bearing cavity 52 may extend along the central axis 11 and around the shaft 24. A bearing assembly 54 may be positioned in the bearing cavity 52 and may include an inner race 56 and an outer race 58. The inner race 56 may have a hollow, substantially cylindrical shape and may closely fit over the shaft 24 around a bearing segment. The outer race may also have a hollow, substantially cylindrical shape and may fit closely within the bearing cavity 52. A cylindrically shaped gap may be provided between the inner race 56 and the outer race 58, with annular grooves in the inner and outer races carrying a number of ball bearings 60 so that the inner and outer races may freely rotate relative to one another. The bearing assembly 54 may be lubricated, and an oil delivery system may be provided with a supply channel system 62, which may be interconnected with an associated engine's pressurized oil delivery system.

The bearing housing 26 may have a section extending into the turbine housing 20. A wall section 64 may extend axially toward the turbine wheel 16 and may extend around the circumference of the bearing cavity 52. The wall section 64 may turn radially inward and extend into a section forming an end wall 68 formed around the shaft and separating the exhaust channel area 70 around turbine wheel 16 from the area of the bearing cavity 52. The end wall 68 may include a segment that defines an end opening 71 about the central axis 11 within which the shaft 24 may be rotatably supported.

A heat shield 72 may have a central opening through which the shaft 24 extends and may have a peripheral rim forming an outer flange 76 configured to be engaged between the turbine housing 20 and the bearing housing 26. The heat shield 72 may be formed generally in a cup shape that opens toward the bearing housing 26. The heat shield 72 may shield the end wall 68 from the direct heat of the exhaust gases in the exhaust channel area 70 around turbine wheel 16.

As shown in FIG. 2, the flange 38 of the bearing housing 26 may have a number of radially outward extending tabs including tab 82 with opening 83 through which fastener 84 is applied to clamp the bearing housing 26 to the wall 40 of the turbine housing 20. The tab 82 may be spaced apart from the wall 40 by hollow cylindrical spacer 85 that is disposed in the axial direction so that the fastener 84 extends through the spacer 85. The spacer 85 may be captured between the bearing housing 26 and the turbine housing 20 under the force of fastener 84, without contacting a set of cooling plates 78, 79, and 80. The set of cooling plates 78, 79, 80 may be connected to the wall 40 of the turbine housing 20. The cooling plates 78, 79, 80 may include openings 86, 87, 88 through which the spacer 85 and the fastener 84 extend. Cooling plates 78 and 79 may be separated by a spacer 90 that may extend around the turbine housing 20 and may include a number of openings such as opening 91 through which the spacer 85 and the fastener 84 extends. Cooling plates 79 and 80 may be separated by a spacer 92 that may extend around the turbine housing 20 and may include a number of openings such as opening 93 through which the spacer 85 and the fastener 84 extends. The spacers 90, 92 space the cooling plates apart to allow air movement between the cooling plates to facilitate heat transfer to the atmosphere. The spacers may be captured in place by fasteners that attach the cooling plates 78, 79, 80 to the turbine housing (such as fastener 97 shown in FIG. 3). The set of cooling plates 78, 79, 80 may include an inner periphery 94 through which the flange 38 extends with a gap 95 so that the inner periphery 94 does not directly contact the bearing housing 26. Similarly, the spacer 85 creates a gap 96 between the set of cooling plates 78, 79, 80 and the tab 82. The gaps 95, 96 help minimize the amount of direct contact with the bearing housing 26 to minimize heat transfer to the bearing housing 26. The cooling plates 78, 79, 80 may extend axially from the area between spacer 85 and wall 40 radially outward, ending at a radial distant point beyond the radial outside edge 98 of turbine housing 20.

Figure 3:
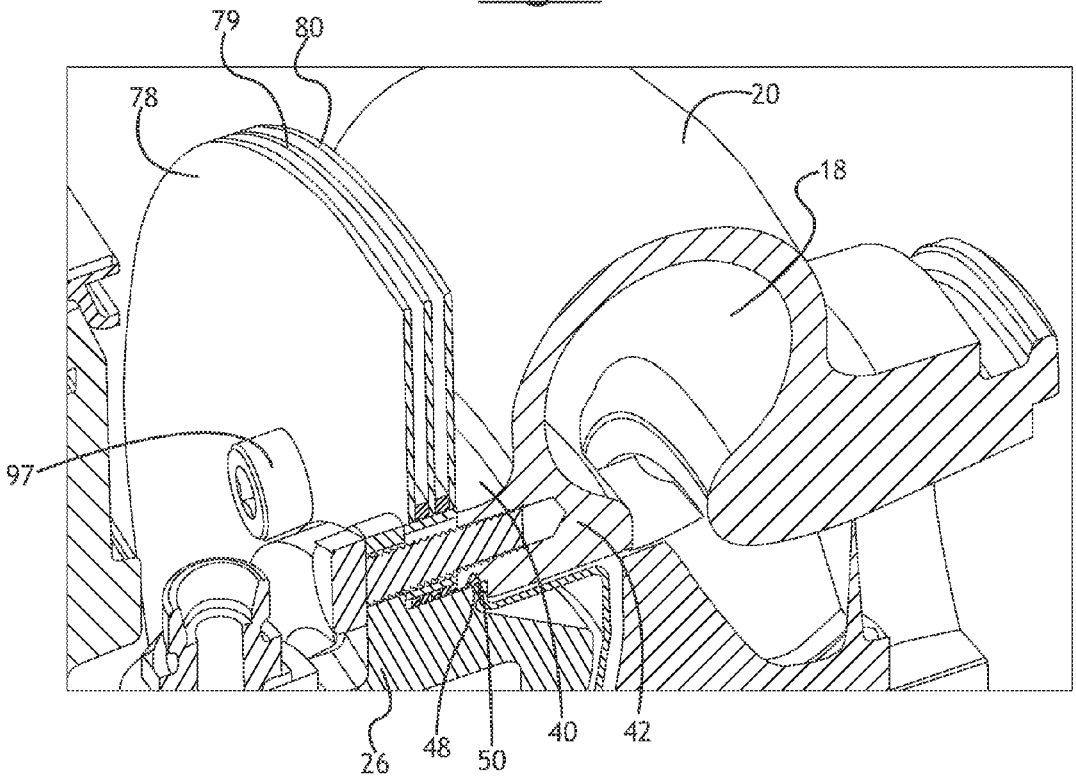
FIG. 3 is a fragmentary, sectioned, isometric illustration of a product for use with a turbocharging system according to a number of variations.

Referring to FIG. 3, the set of cooling plates 78, 79, 80 are shown sectioned, extending around part of the turbine housing 20. The cooling plates 78, 79, 80 may be connected to the wall 40 of turbine housing 20 by a number of fasteners, including a fastener 97 that is spaced apart from the fastener 84 that secures bearing housing 26 to turbine housing 20. The cooling plates 78, 79, 80 may be positioned so that heat absorbed from exhaust gases in the channel of volute 18 into the adjacent wall of housing section 42 is conducted to the wall 40 and there through, to the cooling plates 78, 79, 80 and dissipated to atmosphere. Heat may be redirected to the cooling fins 78, 79, 80 from the turbine housing 20, without being transferred through the bearing housing 26. In addition, direct contact between the turbine housing 20 and the bearing housing 26 is minimized at the circumferential surfaces 48 and 50. This may reduce the heating of the bearing housing 26, thereby reducing heat transfer to the bearing assembly 54 and to the compressor housing 32.

Through the foregoing structure a turbocharging system may include a turbine end heat sink which may include cooling plates to reject heat to the atmosphere that, during operation of the turbocharger, may increase compressor efficiency by reducing heat transfer from the turbine to the compressor. In addition, including after engine shut down during a heat soak period, heat transfer to the bearing housing may be reduced thereby avoiding coking on interior surfaces and reducing bearing heating. The structure may be applied to existing applications with minimal changes. The following description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Variation 1 may involve a product for use with a turbocharging system. The product may include a bearing housing configured to house a bearing and having a flange. A shaft may extend through the bearing and a turbine wheel may be connected to one end of the shaft. A turbine housing may be disposed around the turbine wheel and may include an annular wall adapted to mate with the flange of the bearing housing. A cooling plate may be disposed around, and spaced apart from, the bearing housing. The cooling plate may be connected to the turbine housing to transfer heat from the turbine housing and away from the bearing housing.

Variation 2 may include a product according to variation 1 and may include a fastener connecting the bearing housing to the turbine housing wherein the fastener may extend through an opening in the cooling plate without contacting the cooling plate.

Variation 3 may include a product according to variation 2 and may include a spacer extending through the opening wherein the fastener extends through the spacer.

Variation 4 may include a product according to variation 2 or 3 wherein the flange may include a tab extending from the flange and the fastener may extend through the tab.

Variation 5 may include a product according to any of variations 1 through 4 wherein the cooling plate may be substantially annular in shape with an open center wherein the bearing housing may extend through the open center.

Variation 6 may include a product according to any of variations 1 through 5 wherein the cooling plate may not contact the bearing housing.

Variation 7 may include a product according to any of variations 1 through 6 wherein the turbine housing may include a channel for exhaust gas and the cooling plate may be connected to the turbine housing near the channel.

Variation 8 may include a product according to any of variations 1 through 7 wherein the flange may include a first circumferential surface facing radially outward and the annular wall may include a second circumferential surface facing radially inward. The second circumferential surface may mate with the first circumferential surface and may provide the only direct contact between the bearing housing and the turbine housing to minimize heat transfer from the turbine housing to the bearing housing.

Variation 9 may involve a product for use with a turbocharging system, and may include a turbine housing having a channel adapted to direct a flow of exhaust gas around a turbine to cause the turbine to rotate. The turbine housing may have a first side with an exhaust port to direct the flow of exhaust gas out of the turbine housing and may have a second side opposite the first side adapted to be connected to a bearing housing. The second side may have a wall extending from the turbine housing to a terminal edge forming an annular surface. The wall may define a cavity inside the turbine housing that may be substantially cylindrical shaped. A set of cooling plates may be connected to the annular surface and may extend radially outward from, and around, the turbine housing.

Variation 10 may include a product according to variation 9 wherein each plate in the set of plates may be spaced apart from the other plates in the set of plates by a spacer.

Variation 11 may include a product according to either of variations 9 or 10 and may include a bearing housing having a flange mating with the wall and extending at least partially into the cavity.

Variation 12 may include a product according to variation 11 wherein the wall may include a step formed in an annular shape at an inside edge of the wall, wherein the flange may fit within the annular step.

Variation 13 may include a product according to variation 12 wherein the flange may include a first circumferential surface facing radially outward and the wall may include a second circumferential surface formed inside the step. The second circumferential surface may face radially inward and may mate with the first circumferential surface. The first and the second circumferential surfaces may provide the only direct contact between the bearing housing and the turbine housing to minimize heat transfer from the turbine housing to the bearing housing.

Variation 14 may include a product according to any of variations 11 through 13 wherein the set of cooling plates may not directly contact the bearing housing.

Variation 15 may include a product according to any of variations 11 through 14 and may include a fastener connecting the bearing housing to the turbine housing wherein the fastener may extend through the set of cooling plates without contacting the set of cooling plates.

Variation 16 may include a product according to variation 15 and may include a spacer extending through the set of cooling plates wherein the fastener may extend through the spacer.

Variation 17 may include a product according to either of variations 15 or 16 wherein the flange may include a tab extending from the flange wherein the fastener may extend through the tab.

Variation 18 may include a product according to variation 17 wherein the set of cooling plates does not directly contact the tab.

Variation 19 may involve a turbocharger that may have a bearing housing connected between a turbine housing and a compressor housing. A bearing assembly may be positioned in a bearing cavity of the bearing housing. The bearing assembly may rotatably support a shaft. A turbine wheel may be positioned in the turbine housing and may be connected to an end of the shaft with an exhaust channel defined in the turbine housing around the turbine wheel. The bearing housing may include a section extending into the turbine housing, which may include an end wall formed around the shaft and separating the exhaust channel from the bearing cavity. A set of cooling plates may be connected to the turbine housing and may extend radially outward from and around the turbine housing. The set of cooling plates may be positioned radially outside and around the section, wherein the set of cooling plates may not directly contact the bearing housing.

Variation 20 may include a turbocharger according to variation 19 wherein the bearing housing may be connected to the turbine housing by a fastener and wherein the fastener may extend through an opening in the set of cooling plates without contacting the set of cooling plates.

The above description of select variations within the scope of the invention is merely illustrative in nature and, thus, variations or variants thereof are not to be regarded as a departure from the spirit and scope of the invention.

What is claimed is:

1. A product for use with a turbocharging system comprising: a bearing housing configured to house a bearing, the bearing housing having a flange; a shaft extending through the bearing; a turbine wheel connected to one end of the shaft; a turbine housing disposed around the turbine wheel and including an annular wall adapted to mate with the flange; and a cooling plate disposed around and spaced apart from the bearing housing, the cooling plate connected to the turbine housing to transfer heat from the turbine housing and away from the bearing housing.

2. The product according to claim 1 further comprising a fastener connecting the bearing housing to the turbine housing wherein the fastener extends through an opening in the cooling plate without contacting the cooling plate.

3. The product according to claim 2 further comprising a spacer extending through the opening wherein the fastener extends through the spacer.

4. The product according to claim 2 wherein the flange includes a tab extending from the flange wherein the fastener extends through the tab.

5. The product according to claim 1 wherein the cooling plate is substantially annular in shape with an open center wherein the bearing housing extends through the open center.

6. The product according to claim 1 wherein the cooling plate does not contact the bearing housing.

7. The product according to claim 1 wherein the turbine housing includes a channel for exhaust gas and the cooling plate is connected to the turbine housing near the channel.

8. The product according to claim 1 wherein the flange includes a first circumferential surface facing radially outward and the annular wall includes a second circumferential surface facing radially inward, the second circumferential surface mating with the first circumferential surface, the first and the second circumferential surfaces providing the only direct contact between the bearing housing and the turbine housing to minimize heat transfer from the turbine housing to the bearing housing.

9. A product for use with a turbocharging system comprising: a turbine housing having a channel adapted to direct a flow of exhaust gas around a turbine to cause the turbine to rotate, the turbine housing having a first side having an exhaust port to direct the flow of exhaust gas out of the turbine housing and a second side opposite the first side adapted to be connected to a bearing housing, the second side having a wall extending from the turbine housing to a terminal edge forming an annular surface, the wall defining a cavity inside the turbine housing that is substantially cylindrical shaped; and a set of cooling plates connected to the annular surface and extending radially outward from, and around, the turbine housing.

10. The product according to claim 9 wherein each plate in the set of plates is spaced apart from the other plates in the set of plates by a spacer.

11. The product according to claim 9 further comprising a bearing housing having a flange mating with the wall and extending at least partially into the cavity.

12. The product according to claim 11 wherein the wall includes a step formed in an annular shape at an inside edge of the wall, the flange fitting within an annular step.

13. The product according to claim 12 wherein the flange includes a first circumferential surface facing radially outward and the wall includes a second circumferential surface formed inside the step, the second circumferential surface facing radially inward and mating with the first circumferential surface, the first and the second circumferential surfaces providing the only direct contact between the bearing housing and the turbine housing to minimize heat transfer from the turbine housing to the bearing housing.

14. The product according to claim 11 wherein the set of cooling plates does not directly contact the bearing housing.

15. The product according to claim 11 further comprising a fastener connecting the bearing housing to the turbine housing wherein the fastener extends through the set of cooling plates without contacting the set of cooling plates.

16. The product according to claim 15 further comprising a spacer extending through the set of cooling plates wherein the fastener extends through the spacer.

17. The product according to claim 15 wherein the flange includes a tab extending from the flange wherein the fastener extends through the tab.

18. The product according to claim 17 wherein the set of cooling plates does not directly contact the tab.

19. A turbocharger comprising: a bearing housing connected between a turbine housing and a compressor housing, a bearing assembly positioned in a bearing cavity of the bearing housing, the bearing assembly rotatably supporting a shaft; a turbine wheel positioned in the turbine housing and connected to an end of the shaft with an exhaust channel defined in the turbine housing around the turbine wheel; the bearing housing including a section extending into the turbine housing, the section including an end wall formed around the shaft and separating the exhaust channel from the bearing cavity; and a set of cooling plates connected to the turbine housing and extending radially outward from and around the turbine housing, the set of cooling plates positioned radially outside and around the section, wherein the set of cooling plates does not directly contact the bearing housing.

20. The turbocharger according to claim 19 wherein the bearing housing is connected to the turbine housing by a fastener and wherein the fastener extends through an opening in the set of cooling plates without contacting the set of cooling plates.

* * * * *